United States Patent [19]

Holcomb

[11] Patent Number: 4,763,838

[45] Date of Patent: Aug. 16, 1988

[54] SPRINKLER WITH GUARD

[75] Inventor: Gregory B. Holcomb, Diamond Bar, Calif.

[73] Assignee: The Toro Company, Minneapolis, Minn.

[21] Appl. No.: 3,345

[22] Filed: Jan. 12, 1987

[51] Int. Cl.[4] ..... B05B 15/10

[52] U.S. Cl. ..... 239/205; 239/288

[58] Field of Search ..... 239/203–206, 239/240–242, 288, 288.5, 288.3

[56] References Cited

U.S. PATENT DOCUMENTS

| | | | |
|---|---|---|---|
| 1,058,549 | 4/1913 | Cathcart . | |
| 1,259,902 | 3/1918 | Parker . | |
| 1,628,041 | 5/1927 | Frye . | |
| 2,901,183 | 8/1959 | Kohl | 239/205 |
| 3,035,778 | 5/1962 | Kimbro et al. | 239/204 |
| 3,567,125 | 3/1971 | Houghton | 239/204 |
| 3,709,435 | 1/1973 | Sheets | 239/206 |
| 4,145,003 | 3/1979 | Harrison et al. | 239/288 |
| 4,351,477 | 9/1982 | Choi | 239/205 |
| 4,429,832 | 2/1984 | Sheets | 239/204 |

*Primary Examiner*—Andres Kashnikow
*Assistant Examiner*—Kevin Patrick Weldon
*Attorney, Agent, or Firm*—James W. Miller

[57] ABSTRACT

An improved sprinkler (2) includes a body (4) which includes a pop-up nozzle (10). Nozzle (10) is sufficiently smaller than body (4) to create a gap therebetween as nozzle (10) rises out of body (4). An annular guard (30) separate from nozzle (10) is located in the upper end of body (4) and is normally urged out of body (4) by a spring (34). Guard (30) is normally engaged by a cover (18) on nozzle (10) so that nozzle (10) normally keeps guard (30) retracted within body (4). However, as nozzle (10) rises from body (4), guard (30) will be projected upwardly substantially as soon as nozzle (10) rises to immediately seal the gap. Stops (40) and (42) are provided on guard (30) and body (4) for limiting the upward movement of guard (30) to an amount less than the upward movement of nozzle (10).

19 Claims, 2 Drawing Sheets

SPRINKLER WITH GUARD

TECHNICAL FIELD

This invention relates to a sprinkler having a nozzle which pops out of the sprinkler body when water is applied thereto to conduct a sprinkling operation. More particularly, this invention relates to such a sprinkler also having a guard that rises from the sprinkler body when the nozzle pops up to prevent debris from falling into the body.

BACKGROUND OF THE INVENTION

Pop-up sprinklers are well known and usually comprise a sprinkler body buried in the ground at or slightly below ground level. A nozzle is slidably contained within the body for axial movement and is normally retracted within the body by a retraction spring. When water under pressure is applied to the body, e.g. through a fluid inlet in the body, the water acts against the nozzle and pushes the nozzle upwardly against the bias of the retraction spring until a nozzle orifice located on the nozzle is above the ground. The top of the nozzle usually includes a cover for closing the normally open upper end of the body when the nozzle is retracted. Such sprinklers may include a rotary drive means for rotating the nozzle about a substantially vertical axis to water a circle or a portion thereof. Typical pop-up sprinklers known in the prior art are the large turf green driven rotors. i.e. the 630, 650, 660, 670, 680 or 690 Series, a manufactured by The Toro Company, the assignee of the present invention.

Since these above-noted sprinklers are often used in areas where people often walk or play such as golf courses, athletic fields, etc., the sprinklers are typically installed slightly below grade to prevent people from tripping on them. In such sprinklers, the nozzle often comprises a relatively small or slender nozzle body which contains the nozzle orifice. The nozzle body is sufficiently smaller than the diameter of the sprinkler body so that a considerable gap exists therebetween as the nozzle rises. Thus, it is not unusual for dirt and debris from the area surrounding the sprinkler to fall into this gap when the nozzle is popped up. Moreover, grass or other growing vegetation around the sprinkler body will also try to intrude its way into this gap and thereby impede the upward and downward movement of the nozzle.

U.S. Pat. No. 4,429,832 to Sheets recognizes the problems caused by the above-noted gap and discloses one attempted solution. In this patent, a sprinkler is disclosed in which a relatively rigid annular guard is fixedly attached to the nozzle by a plurality of attachment arms. The guard is relatively short and does not extend above the middle of the nozzle to allow the nozzle orifice at the upper end of the nozzle to clear the guard, as is necessary to conduct a sprinkling operation. While the guard is generally received inside the upper end of the sprinkler body, the guard is nonetheless located a substantial distance below the upper end of the body in the reflected position of the nozzle. As the nozzle rises under the influence of water pressure, the guard is projected up out of the body. When the nozzle is fully risen, the guard is located up above the body to seal the gap and prevent debris from falling into the body.

While the guard shown in the Sheets patent addresses the problems created by the gap, it has a number of shortcomings. For one thing, it requires some type of attachment means, such as the radiating arms, to rigidly secure it to the nozzle. To that extent, the guard is more difficult to manufacture and assemble since it requires a number of additional manufacturing or assembly steps, e.g. securing the arms both to the nozzle and the guard.

More importantly, the rigid attachment of the Sheets guard to the nozzle requires that the guard be below the nozzle orifice, and thus necessarily below the upper edge of the sprinkler body in the fully retracted position of the nozzle. With such a construction, the guard does not always effectively seal the gap. For example, during the initial upward rise of the nozzle, the guard does not reach the gap to begin sealing it until the nozzle has risen the amount which the guard is offset below the top of the body. Similarly, when the nozzle is being retracted, the guard passes back down into the sprinkler body before the nozzle is fully retracted, thereby allowing the gap to reappear during the final phases of the downward movement of the nozzle. Thus, the guard of the Sheets patent does not seal the gap over the full range of motion of the nozzle, thereby allowing some debris to fall into the sprinkler during the initial upward movement or final backward movement of the nozzle.

SUMMARY OF THE INVENTION

One aspect of this invention is an improved sprinkler having a body that can be buried in the ground and connected to a source of water. A nozzle pops up out of the body when the water is turned on. The nozzle has an external shape which creates a gap between it and the body as it rises. Means are provided for retracting the nozzle into the body when the water is turned off. The present invention relates to an improved guard that rises from the body as the nozzle rises to seal the gap and thereby prevent debris from entering the body. The guard is separate from the nozzle and a means is located in the body for biasing the guard upwardly out of the body. Finally, the nozzle includes means for bearing against the guard for keeping the guard retracted in the body against the force of the biasing means when the nozzle is retracted, thereby allowing the guard to be pushed up out of the body by its biasing means as the nozzle rises.

Another aspect of this invention is a sprinkler of the type noted above in which the improved guard has a top edge which is located at approximately a top surface of the body. A means is provided responsive to the upward movement of the nozzle for causing the guard to rise substantially as soon as the nozzle rises, whereby the gap is sealed by the guard substantially as soon as it appears. Finally, a means is provided for limiting the upward movement of the guard to an amount less than the upward movement of the nozzle, whereby the nozzle orifice clears the guard to allow a sprinkling operation to take place.

BRIEF DESCRIPTION OF THE DRAWINGS

The present invention will be described in more detail hereafter in the following Detailed Description, when taken in conjunction with the following drawings, in which like reference numerals refer to like elements throughout.

DETAILED DESCRIPTION

Figure 1:
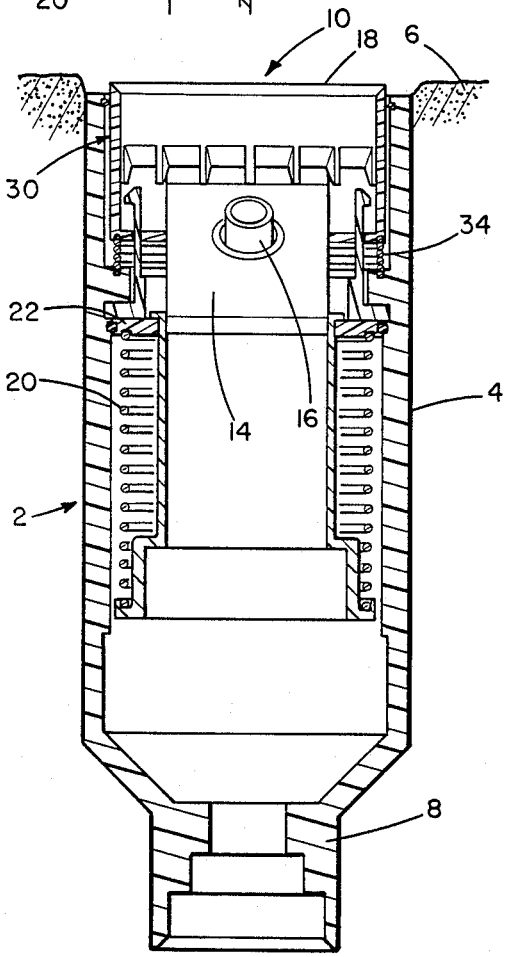
FIG. 1 is a side elevational view, shown partially in cross-section, of a first embodiment of an improved sprinkler according to the present invention, particularly illustrating the nozzle and guard in their retracted positions within the sprinkler body.
Figure 2:
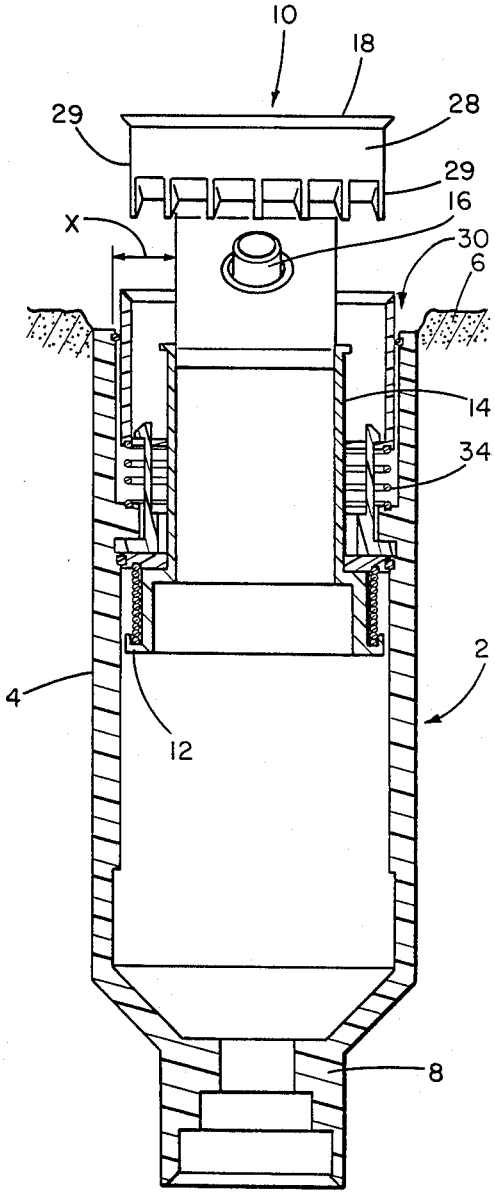
FIG. 2 is a side elevational view similar to that of FIG. 1, but illustrating the nozzle and guard in their raised operative positions during a sprinkling operation.

The present invention relates to an improved pop-up sprinkler 2 comprising a generally cylindrical sprinkler body 4 having a hollow interior. Body 4 is suited to be buried in the ground 6 approximately at ground level, and preferably slightly below, as illustrated in FIGS. 1 and 2. A fluid inlet 8, e.g. a screw threaded female nipple, is provided in body 4 for connection to a source of water under pressure to allow such water to be admitted into the hollow interior of body 4. A suitable selectively operable valve (not shown) is located at or upstream of inlet 8 so that the water can be selectively turned on and off.

Sprinkler 2 also includes a pop-up nozzle 10, often referred to as a riser in such sprinklers, that includes a piston surface 12 at its lower end, a vertically upwardly extending nozzle body 14 having a nozzle orifice 16 therein, and a top cover 18. Cover 18 is circular and has a diameter which normally closes the open upper end of body 4. In addition, nozzle body 14 has an external shape (usually cylindrical or a plurality of cylindrical portions) which is smaller in area than the area of sprinkler body 4, thereby creating a space or gap between the two, identified as X in FIG. 2. Gap X is present whenever nozzle 10 rises upwardly and cover 18 no longer seals the top of body 4. The exact dimensions of the gap X may change as different cylindrical portions of nozzle 4 rise upwardly and become adjacent the upper end of sprinkler body 4, but this is not important to the present invention which relates to an improved guard 30 for sealing the gap X. Suffice it to say that the gap is of sufficient size so that it presents a problem in terms of grass, dirt and other debris extending into or falling down into the gap. Such debris could damage sprinkler 2 or otherwise impede its proper operation.

As shown in FIGS. 1 and 2, nozzle 10 is normally fully retracted within sprinkler body 4 by a retraction spring 20 that bears at its lower end against a seat in piston surface 12 of nozzle 10 and at its upper end in a recess in a spring retainer 22. Spring retainer 22 forms a fixed abutment in body 4 and normally seals against the sides of nozzle body 14 to prevent water from leaking around nozzle 10. Spring retainer 22 is held in body 4 by a conventional split snap ring 24 which fits into an annular groove 26 in body 4. See FIG. 3.

In the normal operation of sprinkler 2, when there is no or little water pressure at fluid inlet 8, retraction spring 20 pushes downwardly on the piston surface 12 of nozzle 10 to retract nozzle 10 within body 4 until cover 18 closes the top end thereof. See FIG. 1. However, when water pressure is present at inlet 8, e.g. the control valve is turned on upstream, the water pressure effectively acts against piston surface 12 to "pop" nozzle 10 up out of body 4 into a sprinkling position. The water then passes through any suitable apertures in piston surface 12 and nozzle body 14 to enter nozzle orifice 16 and be ejected outwardly therefrom. In addition, nozzle body 14 could include a drive means for causing nozzle 10, or at least the portion thereof containing nozzle orifice 16, to rotate about a substantially vertical axis to water a circle or a portion thereof. In this regard, a crown head 28 having downwardly depending deflector fingers 29 is positioned and built to rotate at a different speed from nozzle 10 so that fingers 29 periodically interrupt the stream ejected from orifice 16, thereby aiding pattern dispersal. All of the constructional details of sprinkler 2 recited so far are well known in the art as embodied in the Series 660 or 680 sprinklers sold by The Toro Company, the assignee of the present invention.

The present invention relates particularly to a sprinkler 2 having an improved guard 30 located in the upper end of sprinkler body 4 between body 4 and nozzle body 14. In a first embodiment, guard 30 comprises an annular and cylindrical shield 32 made of a relatively rigid material, e.g. from a hard plastic material similar to the materials often used in sprinkler body 4 and nozzle 10. An O-ring type seal 31 contained in the upper end of body 4 bears against the side of guard 30 (although this seal could be dispensed with if guard 30 fits relatively closely within the inner diameter of body 4). See FIG. 3. An important feature of guard 30 is that it is separate from and not connected to nozzle 10. In addition, a separate and independent biasing means, defined by a second spring 34 placed between an upwardly facing abutment 35 in body 4 and a spring receiving groove in the lower portion of guard 30, normally biases guard 30 upwardly out of sprinkler body 4. However, guard 30 is sized to be received beneath cover 18 of nozzle 10 so that cover 18 abuts against the upper edge of guard 10. Thus, nozzle 10 when fully retracted keeps guard 30 retained inside the upper end of sprinkler body 4 against the force of spring 34. Obviously, retraction spring 20 is strong enough to not only retract nozzle 10, but also overcome the upward biasing force on guard 30.

Figure 3:
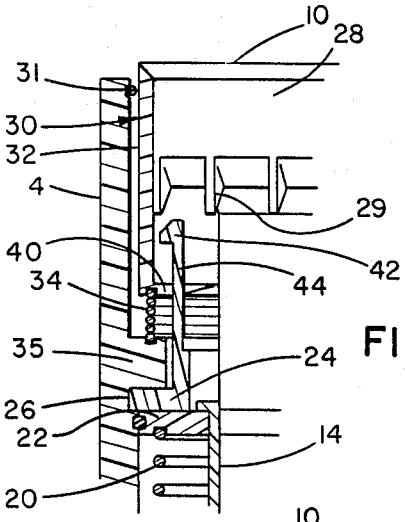
FIG. 3 is an enlarged cross-sectional view of a portion of the sprinkler shown in FIGS. 1 and 2, particularly illustrating the upwardly biased guard and stop means for limiting its upward movement.

In addition to the foregoing, improved guard 30 also includes some means for limiting the upward movement of guard 30 out of sprinkler body 4. Referring to FIGS. 1–3, in a first embodiment this limiting means includes a first stop defined by an annular rim or ledge 40 on the inner diameter of guard 30 adjacent the lower edge thereof and at least one second stop fixed relative to sprinkler body 4 for engaging rim 40 and preventing further upward movement of guard 30. Preferably, there are a plurality of such second stops spaced around the circumference of snap ring 24 each of which individually comprises an outwardly directed tang or flange 42 located on the upper end of a support arm 44 that is fixed to the top surface of snap ring 24. See FIG. 3. Arms 44 are sufficiently long to allow guard 30 to project up out of body 4 in distance which is sufficient to prevent dirt and debris from falling into sprinkler body 4, e.g. a couple of inches, but which then stop the upward motion of guard 30 at a point at which some further upward motion is still allowed for nozzle 10. This additional upward motion of nozzle 10 then serves to project the nozzle upwardly relative to guard 30 sufficiently far until nozzle orifice 16, which was initially within guard 30, has cleared the top surface of guard 30 so that water can be ejected therefrom without hitting the guard. See FIG. 2.

Considering now the operation of sprinkler 2 with the improved guard 30 of the present invention, when the water is turned on and nozzle 10 begins to rise, guard 30 will also rise substantially as soon as nozzle 10 does since second spring 34 is always constantly urging guard 30 up into engagement with cover 18 on nozzle 10. Thus, guard 30 is effective in sealing the gap X between nozzle 10 and sprinkler body 4 substantially as soon as it appears, i.e. in effect no gap ever appears. Conversely, considering the retraction of nozzle 10 from its fully extended position in FIG. 2 to its fully retracted position in FIG. 1, guard 30 remains projected up out of body 4 during the initial downward motion of nozzle 10. Only when the nozzle has fallen far enough so that cover 18 engages the upper edge of guard 30 does the guard begin to retract and it retracts only to the extent that nozzle 10 continues its downward motion. Thus, the present invention constitutes a guard 30 which is effective over the full range of motion of nozzle 10 in sealing the gap X between nozzle 10 and sprinkler body 4.

Guard 30 according to this invention has numerous advantages. Because guard 30 is no longer fixedly attached to nozzle 10, as in some prior art devices, it is now possible to use a second spring 34 and to position guard 30 at the very top of sprinkler body 4 so that it rises as soon as nozzle 10 does and retracts only when nozzle 10 does. Thus, guard 30 seals the gap X much more effectively than these prior art devices since there is never a time in the motion of nozzle 10 when the guard is needed but it is not in place. It is always in place when needed. In addition, a sprinkler 2 with an improved guard 30 according to the present invention is somewhat simpler to construct and assemble since guard 30 is simply an annular shell with no need for any attaching steps in which guard 30 is secured to nozzle 10. Accordingly, there is less material and assembly time required in a sprinkler having the improved guard 30 shown herein.

Various modifications of sprinkler 2 will be apparent to those skilled in the art. for example, it is desirable in some cases that the second stops 42 be attached by arms 44 to the snap ring 24 since this allows a sprinkler body 4 which may be cylindrical all the way to the top with no need for a separate cap. However, various arrangements of limiting means could be used as long as some means is present for limiting the upward motion of guard 30 out of sprinkler body 4 to an amount less than the upward motion of nozzle 10. In addition, other types of upward biasing means could be used on guard 30 in place of second spring 34.

While sprinkler 2 has the various advantages noted above, nozzle 10 in sprinkler 2 may, in some cases, retract more slowly than is desirable. Considering sprinkler 2 in its fully extended operating position shown in FIG. 2, retraction of nozzle 10 begins when the pressurized water to body 4 is turned off. However, during retraction there is often some residual water in the interior of nozzle 10 and in that area of sprinkler body 4 beneath spring retainer 22, the existence and amount of such water depending in part on the static head pressure at sprinkler 2 resulting from the difference in elevation between the sprinkler and the water supply source. As nozzle 10 retracts, this residual water has to be displaced and normally simply "spits out" of nozzle orifice 16 in the manner of a faucet. However, when nozzle 10 of sprinkler 2 reaches the position of guard 30 and closes the top of guard 30, the residual water now can be displaced from sprinkler 2 only by leaking up around cover 18 or by traveling around the bottom of guard 30 and up past seal 31 if seal 31 is used. While this residual water is able to eventually be displaced, e.g. by leaking past seal 31 or cover 18, the reduced area in which the water moves to escape body 4 slows down the rate at which nozzle 10 and guard 30 retract into body 4.

Accordingly, Applicant has developed another embodiment of a sprinkler according to the present invention, i.e. one having the improved guard noted above, which will allow nozzle 10 and guard 30 to retract more quickly than the embodiment of sprinkler 2 for use in sprinkler applications where slow nozzle retraction is a problem and cannot be tolerated. This is the embodiment illustrated as sprinkler 102 in FIGS. 4 and 5. All the elements of sprinkler 102 which are similar or identical to corresponding elements in sprinkler 2 will be referred to by the same reference numerals as used in sprinkler 2 with a "100" prefix.

Figure 4:
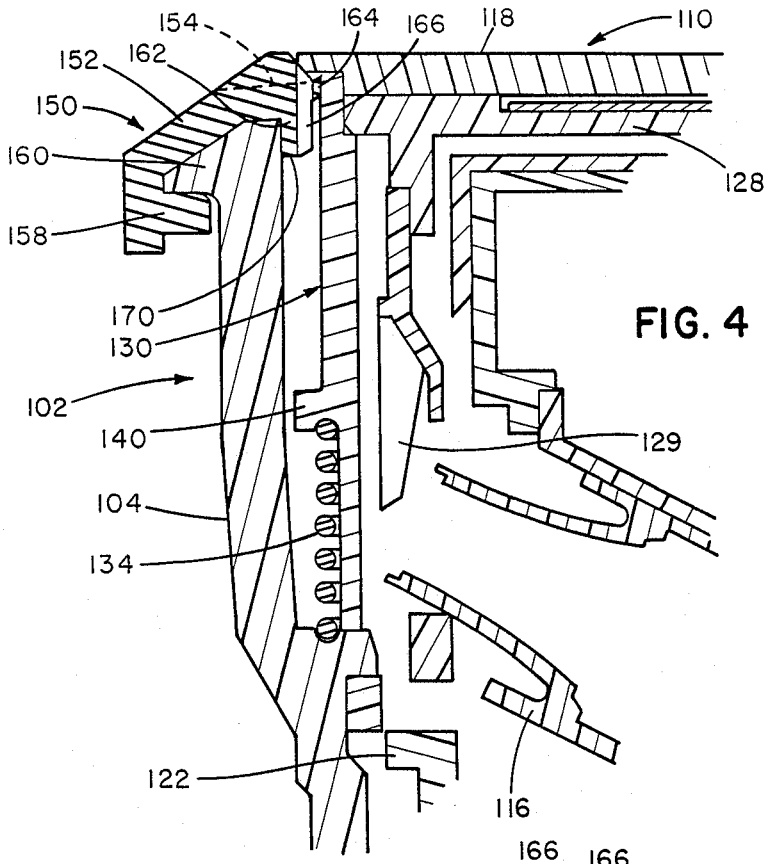
FIG. 4 is a partial side elevational view, shown in cross-section, of a second embodiment of an improved sprinkler according to the present invention, particularly illustrating the nozzle and guard in their retraced positions within the sprinkler body.
Figure 5:
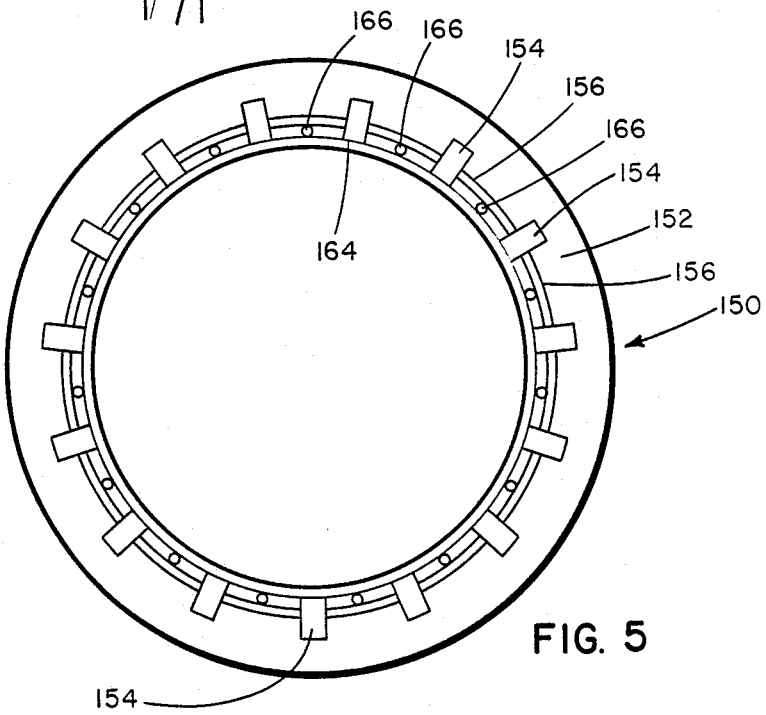
FIG. 5 is a top plan view of a portion of the sprinkler shown in FIG. 4, namely the rubber ring which comprises part of the stop means for limiting the upward movement of the guard.

Referring now to FIGS. 4 and 5, the major difference between sprinkler 2 and sprinkler 102 lies in a different means for limiting the upward movement of the guard which also preferably includes a means for bleeding water away from sprinkler body 104 as nozzle 110 retracts. In sprinkler 102, the first stop in the limiting means comprises an annular rim 140 now positioned on the outside diameter of guard 130. In addition, an annular rubber ring 150 is releasably attached to the upper end of sprinkler body 104 to form a cap or cover for sprinkler 102 with ring 150 also serving as the second stop which engages rim 140. Ring 150 comprises an annular body 152 having a plurality of radially extending slots 154 located between adjacent lands 156. See FIG. 5. The outer diameter of ring body 152 includes a substantially horizontal flange 158 which is inwardly directed and which snap fits beneath an outwardly turned lip 160 on the upper end of sprinkler body 104. The flange and lip connection 158 and 160 in combination with the resiliency of rubber ring 150 allows rubber ring 150 to be installed on sprinkler body 104 in a manner similar to that of a plastic Tupperware lid on a bowl. In any event, some type of means is provided for releasably snapping or attaching rubber ring 150 to sprinkler body 104.

In addition, rubber ring 150 also includes a substantially vertically extending wall 162 on the inner diameter thereof which fits down inside the open upper end of sprinkler body 104. A portion of vertical wall 162 is formed as an annular ring seal 164 sized to closely receive guard 130 within it. Seal 164 prevents dirt from falling down into sprinkler body 104 around the outside of guard 130 and helps wipe guard 130 as it moves up and down to keep guard 130 free of debris and relatively clean. In addition, vertical wall 162 includes a plurality of bleed holes 166 which extend around the periphery of rubber ring 150 in the lands 156 between slots 154. The very bottom of vertical wall 164 forms a horizontal and relatively flat stop surface 170 positioned to engage rim 140 on guard 130.

The basic operation of sprinkler 102 is similar to that of sprinkler 2. In other words, as water is turned on to sprinkler body 104 and nozzle 110 rises, guard 130 rises upwardly out of body 104 under the influence of spring 134. The upward movement continues until rim 140 engages stop surface 170 on rubber ring 150, although further upward movement of nozzle 110 is still allowed to position the orifice 116 above guard 130. The major difference in operation between the emboidments is during nozzle retraction. When nozzle 110 retracts and cover 118 reengages the top of guard 130 to close off the open upper end thereof, the residual water still remaining in body 104 now has the additional bleed holes 166 to exit through. The water pushed up through bleed holes 166 will be forced over to the downwardly sloping slots 154 in ring body 152 to drain away from sprinkler 102. Accordingly, since there are now some additional bleed passages for the residual water remaining in the sprinkler body 104 as nozzle 110 retracts, a more rapid retraction of nozzle 110 is allowed. As shown in FIG. 4, when nozzle 110 is fully retracted, cover 118 thereof preferably has a beveled edge which fits over and closes off the normally open bleed holes 166, preventing dirt from falling into the holes.

While sprinkler 2 is a fully effective and usable sprinkler, the sprinkler embodiment 102 may be used in those situations where nozzle retraction is a problem and more rapid retraction is desired. Obviously, various modifications to sprinkler 102 are also possible. For example, any suitable bleed holes located above the level of spring retention member 122 could be used for the purpose of allowing the residual water to bleed to the outside of sprinkler body 104. For example, the bleed holes 166 could be put into the upper end of the sprinkler body 104, or perhaps downwardly through cover 118 and crown head 128. Accordingly, the present invention is to be limited only by the scope of the appended claims.

I claim:

1. An improved sprinkler having a body that can be buried in the ground and connected to a source of water, a nozzle that pops up out of the body when the water is turned on, the nozzle having an external shape which creates a gap between it and the body as it rises, means for retracting the nozzle within the body when the water is turned off, and a guard that rises from the body as the nozzle rises to seal the gap and prevent debris from entering the body, wherein the improvement relates to the guard and comprises:

(a) a guard which is separate from the nozzle;

(b) means for biasing the guard upwardly out of the body, wherein the biasing means comprises a spring extending between the guard and a fixed abutment in the body; and (c) means on the nozzle bearing against the guard for keeping the guard retracted in the body against the force of its biasing means when the nozzle is retracted, whereby the guard is pushed up out of the body by its biasing means as the nozzle rises.

2. An improved sprinkler as recited in claim 1, wherein the guard in its retracted position is closely adjacent the top of the body, whereby the guard rises out of the body substantially as soon as the nozzle begins to rise.

3. An improved sprinkler as recited in claim 1, wherein the guard comprises a relatively rigid annular shell.

4. An improved sprinkler having a body that can be buried in the ground and connected to a source of water, a nozzle that pops up out of the body when the water is turned on, the nozzle having an external shape which creates a gap between it and the body as it rises, means for retracting the nozzle within the body when the water is turned off, and a guard that rises from the body as the nozzle rises to seal the gap and prevent debris from entering the body, wherein the improvement relates to the guard and comprises:

(a) a guard which is separate from the nozzle;

(b) means for biasing the guard upwardly out of the body;

(c) means on the nozzle bearing against the guard for keeping the guard retracted in the body against the force of its biasing means when the nozzle is retracted, whereby the guard is pushed up out of the body by its biasing means as the nozzle rises; and (d) stop means for limiting the upward movement of the guard out of the body.

5. An improved sprinkler having a body that can be buried in the ground and connected to a source of water, a nozzle that pops up out of the body when the water is turned on, the nozzle having a nozzle orifice and an external shape which creates a gap between it and the body as it rises, means for retracting the nozzle within the body when the water is turned off, and a guard that rises from the body as the nozzle rises to seal the gap and prevent debris from entering the body, wherein the improvement relates to the guard and comprises:

(a) a guard having a top edge located approximately at a top surface of the body;

(b) means responsive to the upward movement of the nozzle for causing the guard to rise substantially as soon as the nozzle rises, whereby the gap is sealed by the guard substantially as soon as it appears; and (c) means for limiting the upward movement of the guard to an amount less than the upward movement of the nozzle, whereby the nozzle orifice clears the guard to allow a sprinkling operation to take place, wherein the limiting means comprises:

(i) a first stop located on the guard; and (ii) a second stop located within the body, wherein the second stop is positioned to engage the first stop after the guard has risen a predetermined amount to preclude further upward movement of the guard.

6. An improved sprinkler as recited in claim 5, wherein the second stop is contained on a cap secured to the upper end of the sprinkler body.

7. An improved sprinkler as recited in claim 2, wherein the cap includes a vertically extending annular wall received within the upper end of the body, wherein the second stop is located on the annular wall, and wherein the annular wall further includes a plurality of bleed holes for allowing water to be pushed upwardly through the cap as the nozzle and guard retract.

8. An improved sprinkler as recited in claim 7, wherein the cap comprises a rubber ring having means for releasably affixing the ring to the upper end of the body.

9. An improved sprinkler as recited in claim 7, wherein the annular wall of the cap includes an annular lip for engaging and sealing against the outside of the guard.

10. An improved sprinkler of the type having a body suited to be buried approximately at or slightly below ground level, an inlet in the body for admitting fluid under pressure thereto, a downwardly biased nozzle carried in the body and axially moveable relative thereto by the fluid pressure from a retracted position inside the body to an extended position out of the body, the nozzle being biased to normally return to the retracted position upon removal of the fluid pressure from the body, and a guard that rises from the body as the nozzle rises under the influence of fluid pressure to prevent debris from entering the body, wherein the improvement relates to the guard and comprises:

(a) a generally cylindrical guard contained in the upper end of the body surrounding a portion of the nozzle; and (b) means independent of the fluid pressure for normally biasing the guard upwardly out of the body.

11. An improved sprinkler as recited in claim 10, wherein the guard is made from a hard plastic material.

12. An improved sprinkler, which comprises:

(a) a cylindrical sprinkler body having a hollow interior and a fluid inlet for admitting water under pressure thereto, wherein the sprinkler body is suited to be buried in the ground with a top surface of the sprinkler body being generally coincident with ground level;

(b) a nozzle carried inside the sprinkler body and suited to be extended from the sprinkler body by the force of the water admitted thereto, wherein the nozzle comprises:

(i) a piston received in the sprinkler body above the fluid inlet so that the water can act thereagainst and project the nozzle upwardly;

(ii) a nozzle body extending upwardly from the piston and having a nozzle orifice which communicates with the area below the piston to receive water therefrom, wherein the nozzle body has a cross-sectional shape whose area is less than the area of the sprinkler body so that a gap is present therebetween; and (iii) a circular cover on top of the nozzle body which closes the top of the sprinkler body when the nozzle is retracted within the sprinkler body;

(c) an abutment fixed in the sprinkler body above the level of the piston;

(d) a first spring extending between the piston on the nozzle and the abutment for normally retracting the nozzle into the sprinkler body;

(e) a guard comprising an annular cylinder received inside the sprinkler body having a diameter less than that of the cover on the nozzle body but large enough to fit around the nozzle body, wherein the guard is received between the sprinkler body and the nozzle body beneath the cover thereof so that the cover is able to interfere with and control the vertical movement of the guard;

(f) biasing means within the sprinkler body for pushing the guard upwardly until it engages the cover on the nozzle body, wherein the biasing means has less force than the first spring retracting the nozzle such that the guard rises up out of the sprinkler body only as the nozzle rises up out of the sprinkler body under the influence of water pressure; and (g) stop means cooperating between the guard and the sprinkler body for limiting the upward movement of the guard to an amount sufficiently less than the upward movement of the nozzle body such that the nozzle orifice clears the guard to conduct a sprinkling operation.

13. An improved sprinkler as recited in claim 12, wherein the biasing means comprises a second spring extending between the sprinkler body and the guard.

14. An improved sprinkler as recited in claim 12, wherein the stop means includes a first stop located on the guard and at least a second stop fixed relative to the sprinkler body positioned above the first stop by a distance equal to the desired amount of upward movement of the guard.

15. An improved sprinkler as recited in claim 14, wherein the fixed abutment comprises an annular spring retainer held in place in the sprinkler body by a snap ring, and wherein the second stop is carried on an upwardly extending support arm fixed at its lower end to the snap ring.

16. An improved sprinkler as recited in claim 15, wherein the first stop comprises an annular rim on the guard, and further including a plurality of second stops carried on a corresponding number of support arms fixed to the snap ring for engaging the annular rim.

17. An improved sprinkler as recited in claim 14, wherein the second stop is carried on a cap secured to the upper end of the sprinkler body.

18. An improved sprinkler as recited in claim 17, wherein the cap comprises a rubber ring releasably attached to the upper end of the sprinkler body.

19. An improved sprinkler as recited in claim 17, wherein the cap includes a plurality of bleed holes extending into the upper end of the sprinkler body adjacent the guard for bleeding water to the exterior of the sprinkler body.

* * * * *